US006339398B1

(12) United States Patent
Redvik et al.

(10) Patent No.: US 6,339,398 B1
(45) Date of Patent: Jan. 15, 2002

(54) COMPENSATION OF FAULTY ELEMENTS IN ARRAY ANTENNAS

(75) Inventors: Jonatan Redvik, Kungälv; Bengt Inge Svensson, Mölndal, both of (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 09/539,449

(22) Filed: Mar. 30, 2000

(51) Int. Cl.[7] ..... H01Q 3/24

(52) U.S. Cl. ..... 342/372; 342/368

(58) Field of Search ..... 342/154, 165, 342/174, 368, 372

(56) References Cited

U.S. PATENT DOCUMENTS

| | | | | |
|---|---|---|---|---|
| 5,083,131 A | | 1/1992 | Julian | 342/372 |
| 5,122,806 A | * | 6/1992 | Julian | 342/173 |
| 5,416,489 A | | 5/1995 | Mailloux | 342/173 |
| 6,140,976 A | * | 10/2000 | Locke et al. | 343/853 |

OTHER PUBLICATIONS

Wright, P.J. et al., "Re–Optimisation of Linear and Planar Arrays with Failed Elements", IEE Antennas and Propagation, Apr. 4–7, 1995, Conference Publication No. 407, Apr. 1995, pp. 81–84.

Sandh, H., International–Type Search Report, Search Request No. SE 99/00306, Dec. 20, 1999, pp. 1–3.

* cited by examiner

*Primary Examiner*—Doa Phan
(74) *Attorney, Agent, or Firm*—Jenkens & Gilchrist, P.C.

(57) ABSTRACT

A method and a system are disclosed compensating for failed elements in an antenna array. The method assumes that at least the amplitude and, in most cases, the phase of, at least, some of the individual elements can be controlled to some extent. If one or more of the antenna array radiating elements are failed, at least some remaining elements are used to correct for this. The amplitude and phase radiation pattern of one of the failed elements is then synthesized using K of the remaining elements. The resulting excitation from this synthesis is superimposed on the failed array excitation at the positions of the K remaining elements. This procedure can be repeated for all the failed elements using the principle of superposition. A system utilizing the present method controls via a control unit a T/R module the phase and amplitude of each operating antenna array radiator

5 Claims, 2 Drawing Sheets

COMPENSATION OF FAULTY ELEMENTS IN ARRAY ANTENNAS

TECHNICAL FIELD

The present invention relates to an improved method for compensating changes in an array antenna radiation pattern due to faulty elements by using remaining elements in the array for compensating the change resulting from the failing elements.

BACKGROUND

Large array antennas do have a rather high probability that a fault may occur in one or more of the antenna array elements. If such faults are of the character that certain antenna elements get a reduced or no radiation functionality, fundamental antenna performances, e.g. side lobe levels, are strongly deteriorated.

Instead of hardware repair of the damage, by replacing failing parts, a software solution adjusting amplitude and eventually the phase of the remaining antenna elements may take place for at least partly repairing the damage.

There are found several scientific reports considering this field of techniques. Certain of these references are based on a re-optimization of amplitude and phase for the remaining antenna elements, while others are based on methods within the signal processing to recreate the signals of the failing antenna elements. A number of representative articles are listed below in the last paragraph before the disclosed present claimed improved method.

An U.S. Pat. No. 5,416,489 to Mailloux 1995 describes a procedure and an apparatus for phased array error correction. Mailloux discloses a technique that enables array error correction by replacing the signals from failed elements with processed signals derived from operating elements. However, the technique according to Mailloux assumes that it is already known in which directions the antenna radiation pattern has to be improved. The approach of Mailloux will result in that some of the remaining angles may experience an even more deteriorated performance.

Therefore there has been a demand of further improving the techniques for compensating losses in an array antenna radiation pattern due to faulty elements.

SUMMARY

A method and a system for compensating for failed elements in an antenna array are disclosed. The method assumes that at least the amplitude and, in most cases, the phase of, at least, some of the individual elements can be controlled to some extent.

If one or more of the antenna array radiating elements are failed, at least some remaining elements are used to correct for this. The amplitude and phase radiation pattern of one of the failed elements is then synthesized using K of the remaining elements. The resulting excitation from this synthesis is superimposed on the failed array excitation at the positions of the K remaining elements. This procedure can be repeated for all the failed elements using the principle of superposition.

According to the present method, by positioning a phase reference point of the array antenna in a failed element a unity value for all angles may be synthesized by means of the calculation means. K neighboring elements in the array are selected and weighted with a specific excitation, $exo^{failed}$, of a failed element, for compensating the erroneous antenna radiation pattern. This results in a steering angle independent compensation as a total control vector consists of a sum of a constant compensation vector and an initial control vector.

A system utilizing the method uses a control unit, which comprises a calculation means and the control unit, via a control signal network, controls a T/R-module for each element of the array, whereby the control unit sets the phase and amplitude of each element in the array.

The method is set forth by the independent claim 1 and a further embodiment of the method is set forth by the dependent claim 2.

A system utilizing the present method is set forth by the independent claim 3 and the dependent claim 4–5.

BRIEF DESCRIPTION OF THE DRAWINGS

The invention, together with further objects and advantages thereof, may best be understood by making reference to the following description taken together with the accompanying drawings, in which.

DETAILED DESCRIPTION

General

Each element in an array antenna contributes to the far field by its element radiation pattern, weighted with the excitation of the element and its position relative to the phase reference point. If an element failure occurs caused by malfunction in the actual antenna array, e.g., in the electronics equipment feeding a radiator element or any other malfunction which alters the original function of the element, an approach to the re-optimization problem is to synthesize the contribution of the failed element to the far field by means of at least some of the remaining operating elements. Due to the fact that superposition principles hold, the re-optimized excitation is the sum of the remaining elements original excitation and the contribution excitation of the synthesized failed element according to $$exc_n^{optimum}=exc_n^{original}+exc_n^{corr}n\epsilon\{\text{remaining elements}\}$$

in which $exc_n$ denotes an excitation for an element n.

A correction excitation may be performed for all the remaining elements or for just a couple of them. If the correction is made to the neighboring elements, each failed element, which has the same neighbor configuration, can use the same correction, weighted with the excitation of the failed element. This means that the correction is independent of the position of the failed element, and if several elements fail, the different corrections can be superposed on each other. Another advantage with element radiation pattern synthesis is that the correction excitation is independent of the shape of the element radiation pattern if all element radiation patterns are equal.

The Present Improved New Method

An improved method compensating for failed elements in planar antenna arrays is based on adjusting the excitation of the neighboring elements.

Figure 1:
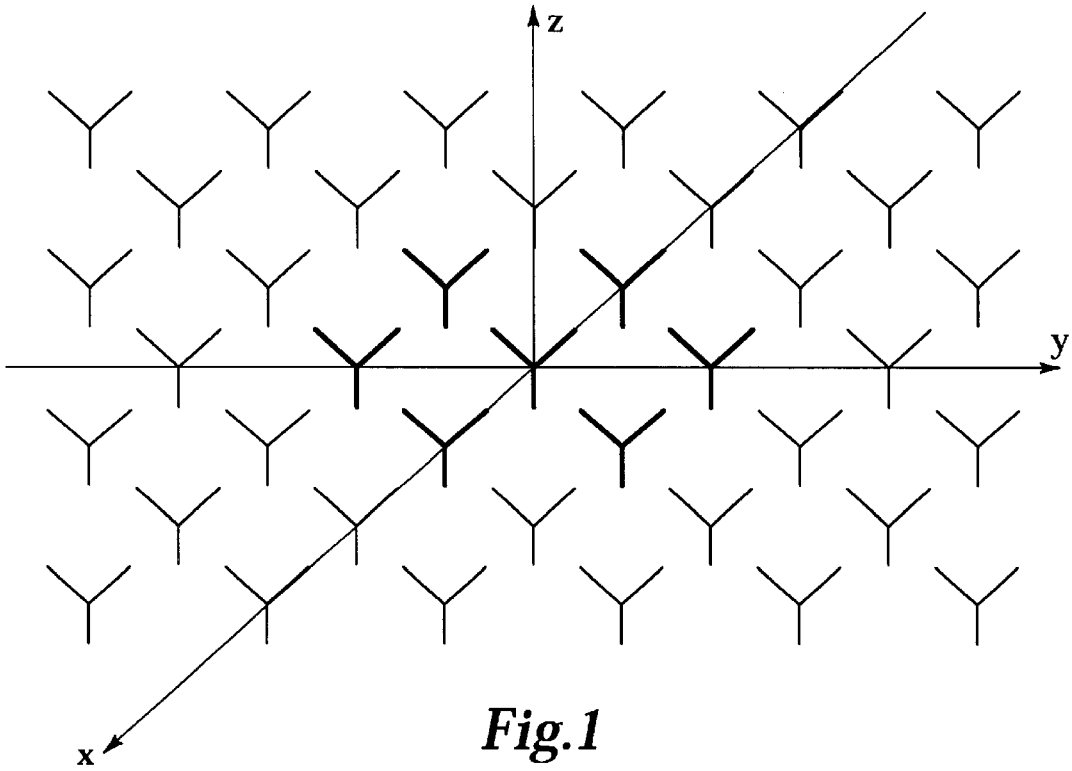
FIG. 1 demonstrates theoretically an antenna array having a failed element in the phase reference point and its neighboring elements.

Suppose that an element failure occurs in a planar array antenna. Put the phase reference point at the failed element in accordance to FIG. 1 and use K neighboring elements which shall compensate for the contribution of the failed element. Since the failed element is positioned in the phase reference point, the phase of the contribution of the element to a far field is zero for all angles. The far field contribution of the failed element is expressed by $$FF^{failed}(u,v)=exc^{failed}\cdot EF(u,v),$$

EF(u,v) denotes the element radiation pattern, also called the element factor, where:

$$\begin{cases} x = \dot{u}\cdot r = r\cdot\sin\theta\cos\phi \\ y = v\cdot r\sin\theta\sin\phi \\ z = r\cdot\cos\theta \end{cases}$$

and the array is positioned in the xy-plane.

The K neighboring elements have a far-field contribution according to $$FF^{neighbor}(u,v) = EF(u,v)\cdot\sum_{k=1}^{K} exc_k^{corr}\cdot e^{-j\cdot k_0\cdot(x_k\cdot u+y_k\cdot v)}$$

The goal is to fully restore $FF^{failed}(u,v)$ by optimizing the correction excitation of the neighboring elements, $exc_k^{corr}$. The propagation constant ko is defined as $2\pi/\lambda o$, where $\lambda o$ denotes the wavelength of the electromagnetic radiation. This is impossible, which is easily understood because if it was possible, it should have been possible to take away an element and then restore the antenna performance. This could then have been done recursively and in the end there would be only one antenna element left, but the initial antenna performance would still have been the same. On the contrary, it is possible to fully restore the contribution of the failed element to the far field in K arbitrary angles.

Since EF(u,v) is present in both the above equations, this optimization method will be independent of the shape of the radiation pattern of the element, if all elements are assumed to be equal. The method will also be independent of the position of the failed element if the optimization synthesizes a unity value for all angles and then weight the solution with the specific excitation $exc^{failed}$ of the failed element. Therefore the optimization problem can be formulated as $$\sum_{k=1}^{K} exc_k^{corr}\cdot e^{-j\cdot k_0\cdot(x_k\cdot u_p+y_k\cdot v_p)} = 1$$

in which p=1, 2, . . . P and $u_p$ and $v_p$ are different angles.

These P simultaneous equations can be written in a matrix equation according to $$A\cdot exc=\vec{1}$$

$$A = \begin{bmatrix} g_1(u_1,v_1) & g_2(u_1,v_1) & \cdots & g_K(u_1,v_1) \\ g_1(u_2,v_2) & g_2(u_2,v_2) & \cdots & g_K(u_2,v_2) \\ \vdots & \vdots & \cdots & \vdots \\ g_1(u_p,v_p) & g_2(u_p,v_p) & \cdots & g_K(u_p,v_p) \end{bmatrix} \quad (1)$$

$$g_k(u_p,v_p)=e^{-j\cdot k_0\cdot(x_k\cdot u_p+y_k\cdot v_p)}$$

$$exc=[exc_1^{cor}, exc_2^{corr}, \ldots, exc_K^{corr}]^T$$

in which $\vec{1}$ is a P element unity row vector. If P=K there exists only one solution to $exc_k$ according to $$exc=[A]^{-1}\cdot\vec{1}$$

But often it is desired to optimize the excitations over many more angles, which will lead to an over-determined equation system, which has no solution. Instead the least mean square error method or any other suitable method may be used to solve the estimation of the correction excitation.

$$exc=[A^T\cdot A]^{-1}\cdot A^T\cdot\vec{1}$$

The optimal excitation of the antenna array with an arbitrary number of element failures is then given by $$exc_n^{optimum} = \begin{cases} exc_n^{orginal} + exc_f^{failed}\cdot exc_n^{corr}, & n\in\{\Omega_f\} \\ exc_n^{original}, & \text{otherwise} \end{cases}$$

in which $exc_f^{failed}$ is the original excitation of the failed element number f and $\Omega_f$ is the set of neighbor elements for failed element number f, f=1, 2, . . . , F where F is the total number of failed elements. In the derivation of the solution of the compensation problem the optimization equation has been set equal to one, which is equivalent to all the elements of the antenna array being equal. In the case when the radiation elements are initially not made equal the problem can still be solved in the similar way by considering a particular initial weighting of some elements before the weighting according to the compensation is performed.

Simplification of the Improved New Method

Figure 2:
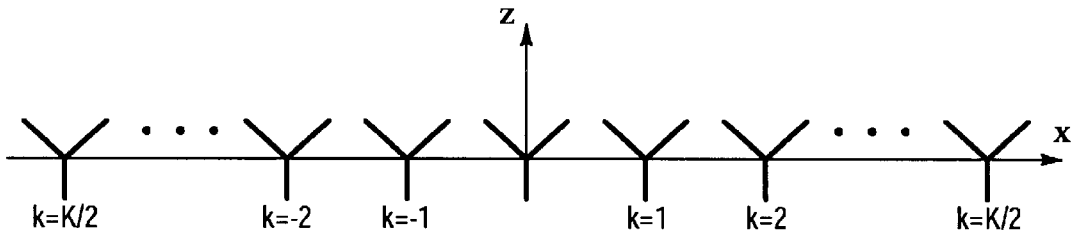
FIG. 2 demonstrates theoretically a linear array having a failed element in the phase reference point.

Suppose that an element failure occurs in a linear array antenna. Put the phase reference point at the failed element according to FIG. 2, and use K (symmetrically positioned) neighboring elements, which shall compensate for the contribution of the failed element. In standard spherical coordinates θ, φ, having the linear array aligned along the x-axis θ=90°, φ=0° and 180°.

Due to the fact that the antenna radiation pattern variation in v is determined solely by the element factor EF, only the cut v=0 will be considered. The far-field contribution of the failed element is $$FF^{failed}(u)=exc^{failed}\cdot EF(u)$$

in which EF(u) is the element factor. The K elements have a far-field contribution according to $$FF^{neighbor}(u) = EF(u)\cdot\sum_{\substack{k=-K/2\\k\neq 0}}^{K/2} exc_k^{corr}\cdot e^{-j\cdot k_0\cdot x_k\cdot u}$$

The optimization problem in the linear array case can be formulated as $$\sum_{\substack{k=-K/2\\k\neq 0}}^{K/2} exc_k^{corr}\cdot e^{-j\cdot k_0\cdot x_k\cdot u} = 1$$

in which p=1, 2, . . . , P and $u_p$ are different cuts u.

These P simultaneous equations can be written in a matrix equation similar to equation (1) on page 6. However if the cuts, $u_p$, are chosen symmetrically around zero, which will be shown appropriately independent of scan angle, the result will show that the excitation correction is carried out symmetrically.

$$exc_k^{corr}=exc_{-k}^{corr}$$

By knowing this fact, it is possible to reduce the size of the problem by utilizing Euler's identity:

$$\cos(\Theta) = \frac{1}{2} \cdot (e^{j\Theta} + e^{-j\Theta})$$

By using these last three equations the problem may now be formulated as $$2 \cdot \sum_{k=1}^{K/2} exc_k^{corr} \cdot \cos(k_0 \cdot x_k \cdot u_p) = 1$$

This new problem formulation can be written in a matrix equation too, but the matrix size is decreased to a quarter.

An Illustrative Embodiment Utilizing the Improved Techniques

Figure 3:
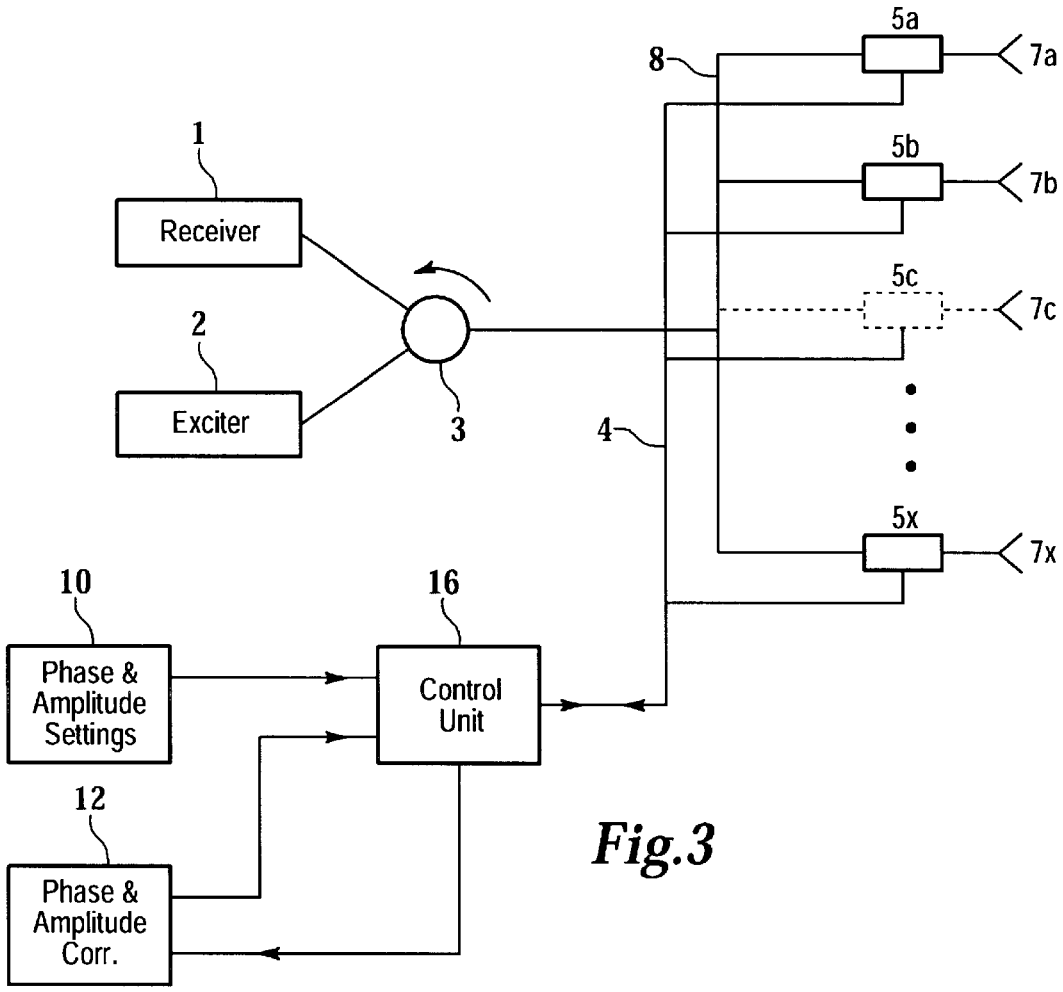
FIG. 3 demonstrates a basic embodiment of an antenna array designed for a possibility to compensate losses in the array antenna radiation pattern due to faulty elements.

FIG. 3 demonstrates a basic embodiment of an antenna array designed for a possibility to compensate deterioration in the array antenna radiation pattern due to faulty elements. The illustrated setup according to FIG. 3 presents a receiver module 1 for the reception of microwave signals and an exciter module 2 generating a transmission signal. The receiver and exciter are via circulator 3 and a RF feed network 8 connected to an array antenna.

The antenna array connected to the circulator 3 via an RF feed network contains n radiating antenna elements 7*a,* 7*b,* 7*c, . . . ,* 7*x,* in which for instance an antenna element 7*c* represents a faulty radiator. Each of the radiator elements are connected to a respective transmit/receive-module (T/R-module) 5*a,* 5*b,* 5*c, . . . ,* 5*x.* A fault may occur either in the T/R-module 5*c* or in the radiating antenna element 7*c* itself, or in any other part affecting the function of the antenna element 7*c.*

Figure 4:
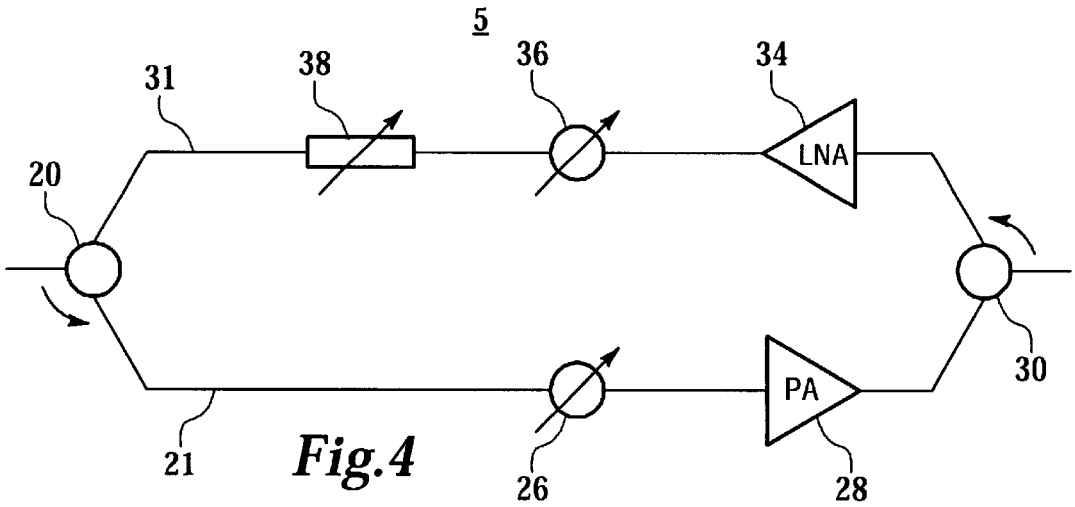
FIG. 4 demonstrates a basic T/R-module used in the embodiment of FIG. 3.

FIG 4 presents the schematic build-up of an embodiment of a T/R-module to be used according to FIG. 3. Such a preferred T/R-module contains a first circulator 20 connecting two branches 21 and 31 together. A second circulator 30 splits the connection to the radiator element into the two branches 31 and 21. Branch 21 further contains a variable phase shifter 26 and a power amplifier 28, while branch 31 contains a low noise amplifier 34, a variable phase shifter 36 and a device 38 with variable attenuation.

All the T/R modules are individually controlled by a control unit 16, which obtains original phase and amplitude settings from a phase and amplitude settings unit 10. The control unit 16 also receives additional information from a phase and amplitude corrections unit 12. The phase and amplitude settings unit 10 is given fixed settings for obtaining a desired radiation pattern. The unit 12 for phase and amplitude corrections may in an illustrative embodiment obtain its correction settings from the control unit 16 itself. The unit 12 then will comprise a processing device being programmed to execute the calculations needed for solving the K equations resulting from the matrix equation (1). The programming will utilize the possible simplifications discussed for applying a suitable high or low level programming language well known to a person skilled in the art. In an illustrative embodiment the processing device of the controller 16 is a microprocessor provided with an arithmetic logic unit, ALU, forming a calculation means for performing the necessary calculations for the compensation according to the present method. Such microprocessor devices are easily available and are well known to persons skilled in the art.

The phase and amplitude control signals from units 10 and 12, which are combined in the control unit, via a control signal network 4 then control the individual T/R-modules. When the controlling processor detects, for instance, that an antenna element, for instance 7*c,* does not present a proper signal response the processor can now via the phase and amplitude corrections unit supply the neighboring elements with phase and amplitude compensated signals. The resulting radiation pattern is accordingly compensated to a high extent and the antenna array will be able to continue to operate satisfactorily until failing portions will be repaired by replacement of the faulty hardware.

The processor calculation is based on the assumption that the faulty element is considered being the phase reference point in this calculation in accordance to present suggested improvement for calculating a phase and amplitude compensation for obtaining a compensation for the failing element of the array antenna.

The present method can of course also be applied to similar systems e.g., antenna systems without active amplifiers in the T/R-modules.

It will be understood by those skilled in the art that various modifications and changes may be made to the present invention without departure from the scope thereof, which is defined by the appended claims.

REFERENCES

[1] P. J. Wright, "Planar array optimization with failed elements", IEE Conference Publication Antennas Proceedings of the 9th International conference on Antennas and Propagation. Part1, Apr. 4–7, 1995.

[2] H. Steyskal, R. J. Mailloux, "Generalization of a phased array error correction method", IEEE Antennas and Propagation Society, AP-S International Symposium (Digest) Proceedings of the 1996 AP-S International Symposium & URSI Radio Science Meeting. Part 1, pp 506–509, Jul. 21–26, 1996.

[3] T. J. Peters, "A conjugate gradient-based algorithm to minimize the side-lobe level of planar arrays with element failures", IEEE Transactions on Antennas and Propagation, Vol. 39, No. 10, pp 1497–1504, October 1991.

[4] M. H. Er, S. K. Hui, "Array pattern synthesis in the presence of faulty elements", Signal-Processing, Vol. 29, No. 1, pp 57–65, October 1992.

[5] S. L. Sim, M. H. Er, "Sidelobe suppression for general arrays in presence of element failures".

What is claimed is:

1. A method for compensating for failed elements in an antenna array comprising the steps of:

arranging a control unit, the control unit comprising a calculation means and the control unit via a control signal network controlling the amplitude and phase settings of each element of the array, positioning a phase reference point of the array antenna in a failed element;

synthesizing by means of the calculation means a unity value for all angles and weighting the solution with a specific excitation $exc^{failed}$ of a failed element, by formulating a correction excitation optimization problem as $$\sum_{k=1}^{K} exc_k^{corr} \cdot e^{-j \cdot k_0 \cdot (x_k \cdot u_p + y_k \cdot v_p)} = 1$$

in which p=1, 2, . . . P and $u_p$, $v_p$ are different angles and ko is a constant;

selecting K neighboring elements of the failed element and selecting the number of different angles P such that P=K to obtain a situation in which there exists only one solution to $exc_n$ which denotes an excitation for an element n according to $$exc=[A]^{-1}\cdot\vec{1}$$

in which $$A=\begin{bmatrix} g_1(u_1,v_1) & g_2(u_1,v_1) & \cdots & g_K(u_1,v_1) \\ g_1(u_2,v_2) & g_2(u_2,v_2) & \cdots & g_K(u_2,v_2) \\ \vdots & \vdots & \cdots & \vdots \\ g_1(u_p,v_p) & g_2(u_p,v_p) & \cdots & g_K(u_p,v_p) \end{bmatrix}$$

$$g_k(u_p,v_p)=e^{-j\cdot k_0\cdot(x_k\cdot u_p+y_k\cdot v_p)}$$

$$exc=[exc_1^{cor},exc_2^{corr},\ldots,exc_K^{corr}]^T,$$

whereby said method results in a steering angle independent compensation as a total control vector consists of a sum of a constant compensation vector and an initial control vector.

2. The method according to claim 1, comprising the further step of using a least mean square error method or any other general method for solving the correction excitation according to $$exc=[A^T\cdot A]^{-1}\cdot A^T\cdot\vec{1}$$

whereby the optimal excitation of the antenna array with an arbitrary number of element failures then is given by $$exc_n^{optimum}=\begin{cases} exc_n^{orginal}+exc_f^{failed}\cdot exc_n^{corr}, & n\in\{\Omega_f\} \\ exc_n^{original}, & \text{otherwise} \end{cases}$$

wherein $exc_f^{failed}$ is the original excitation of the failed element number f and $\Omega_f$ is the set of neighbor elements for failed element number f, f=1, 2, . . . , F where F is the total number of failed elements.

3. A system compensating for failed elements in an antenna array connected to a receiver and a transmitter for receiving and transmitting information, comprising a control unit, the control, via a control signal network controlling amplitude and phase settings of each element of the antenna array, a calculation means included in the control unit, the calculation means being programmed to synthesize a unity value for all angles and weighting the solution with a specific excitation $exc^{failed}$ of a failed element, by means of a correction excitation optimization equation $$\sum_{k=1}^{K} exc_k^{corr}\cdot e^{-j\cdot k_0\cdot(x_k\cdot u_p+y_k\cdot v_p)}=1$$

in which p=1, 2, . . . P and $u_p$, $v_p$ are different angles and ok is a propagation constant, said calculation means further selecting K neighboring elements of the failed element and selecting a number of different angles P such that P=K to obtain a situation in which there exists only one solution to $exc_n$ which denotes an excitation for an element n according to $$exc=[A]^{-1}\cdot\vec{1}$$

in which $$A=\begin{bmatrix} g_1(u_1,v_1) & g_2(u_1,v_1) & \cdots & g_K(u_1,v_1) \\ g_1(u_2,v_2) & g_2(u_2,v_2) & \cdots & g_K(u_2,v_2) \\ \vdots & \vdots & \cdots & \vdots \\ g_1(u_p,v_p) & g_2(u_p,v_p) & \cdots & g_K(u_p,v_p) \end{bmatrix}$$

$$g_k(u_p,v_p)=e^{-j\cdot k_0\cdot(x_k\cdot u_p+y_k\cdot v_p)}$$

$$exc=[exc_1^{cor},exc_2^{corr},\ldots,exc_K^{corr}]^T$$

said control unit then producing corrected phases and amplitudes for the K selected neighboring elements and thereby resulting in a steering angle independent radiation pattern compensation, wherea total control vector consists of the sum of constant compensation vector and an initial control vector.

4. The system according to claim 3, wherein said calculation means uses a least mean square error method or any other general method for solving the correction excitation according to $$exc=[A^T\cdot A]^{-1}\cdot A^T\cdot\vec{1},$$

whereby the optimal excitation of the antenna array with an arbitrary number of element failures then is given by $$exc_n^{optimum}=\begin{cases} exc_n^{orginal}+exc_f^{failed}\cdot exc_n^{corr}, & n\in\{\Omega_f\} \\ exc_n^{original}, & \text{otherwise} \end{cases}$$

wherein $exc_f^{failed}$ is the original excitation of the failed element number f and $\Omega_f$ is the set of neighbor elements for failed element number f, f=1, 2, . . . , F where F is the total number of failed elements.

5. The system according to claim 3, wherein said calculation means of is a microprocessor provided with an Arithmetic Logic Unit to be utilized for performing the necessary calculations.

* * * * *

UNITED STATES PATENT AND TRADEMARK OFFICE

CERTIFICATE OF CORRECTION

PATENT NO. : 6,339,398 B1
DATED : January 15, 2002
INVENTOR(S) : Redvik et al.

It is certified that error appears in the above-identified patent and that said Letters Patent is hereby corrected as shown below:

Column 1,
Line 63, replace "$exo^{failed}$" with -- $exc^{failed}$ --

Column 7,
Line 25, replace "$exc_1^{cor}$" with -- $exc_1^{corr}$ --

Column 8,
Line 9, replace "ok" with -- $K_o$ --
Line 33, replace "$exc_1^{cor}$" with -- $exc_1^{corr}$ --
Line 39, replace "wherea" with -- where a --

Signed and Sealed this

Twenty-first Day of May, 2002

*Attest:*

*Attesting Officer*

JAMES E. ROGAN
*Director of the United States Patent and Trademark Office*